US006602169B1

(12) United States Patent
Patti

(10) Patent No.: US 6,602,169 B1
(45) Date of Patent: Aug. 5, 2003

(54) APPARATUS AND METHOD OF ASSEMBLING AND LOCKING FIXED DUMBELLS, BARBELLS AND THE LIKE

(76) Inventor: Phil Patti, 3575 Ridge Rd., Templeton, CA (US) 93465

( * ) Notice: Subject to any disclaimer, the term of this patent is extended or adjusted under 35 U.S.C. 154(b) by 0 days.

(21) Appl. No.: 09/522,860

(22) Filed: Jan. 19, 2000

Related U.S. Application Data

(60) Provisional application No. 60/145,526, filed on May 17, 1999.

(51) Int. Cl.[7] ..... A63B 21/075
(52) U.S. Cl. ..... 482/107
(58) Field of Search ..... 482/92–100, 106, 482/108, 107; 411/266, 222, 931

(56) References Cited

U.S. PATENT DOCUMENTS 855,463 A * 6/1907 Lemp ..... 192/216
5,154,560 A * 10/1992 Copito ..... 411/266
5,346,449 A * 9/1994 Schlagel ..... 482/107
6,007,268 A * 12/1999 Whittington et al. ..... 403/328

OTHER PUBLICATIONS

"Security Locknuts—Designed to hold your business together," Product Brochure, Security Locknut Inc., Chicago, Illinois 60656.

* cited by examiner

*Primary Examiner*—Stephen R. Crow
(74) *Attorney, Agent, or Firm*—Coudert Brothers LLP

(57) ABSTRACT

A method of assembly, tightening and locking fixed weight dumbbells and barbells which is commonly provided with weight plates whether individual or one piece styles, a handle or bar with or without an end plate and a locking female member to retain plate(s) to the handle or the bar. The locking member consists of a spring steel oblong threaded insert that can be installed in any shape body i.e. hex, square, round etc. The insert threads over a threaded handle or bar and retains the plates in different size weight configurations. The threaded insert goes on under light hand tool pressure and conforms to the threaded handle or bar. Once applied pressure ceases it locks into position. It may be adjusted as needed and will riot loosen under shock or vibration. It will lock wherever it is left and is considered tension adjustable. It will adapt to wear and may be tightened or loosened as many times as the circumstances require.

12 Claims, 5 Drawing Sheets

Figure 1A:
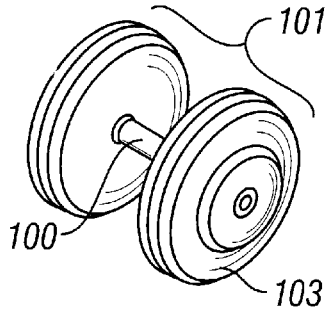
FIG. 1A (Prior Art)

APPARATUS AND METHOD OF ASSEMBLING AND LOCKING FIXED DUMBELLS, BARBELLS AND THE LIKE

This application claims the benefit of U.S. Provisional Application No. 60/145,526, filed May 17, 1999, which application is hereby incorporated herein by reference in its entirety and from which priority is hereby claimed under 35 U.S.C. §§119(e) and 120.

BACKGROUND OF THE INVENTION

1. Field of the Invention

The present invention relates generally to an apparatus and method of locking and, more particularly, an apparatus and method for assembling and locking fixed dumbbells and barbells, wherein a threaded handle or bar is used in combination with individual plates, a solid block of cast iron or steel and a female type locking insert. These items are used to assemble and lock into place fixed permanent weight dumbbells and barbells.

2. Description of the Prior Art

Fixed dumbbells and barbells have been used for over 50 years in commercial exercise environments, i.e. health clubs, gyms, schools, YMCA's, etc. The word, "commercial" dictated high use and more punishment. The fixed method means that the adding or subtracting of weight is not possible by the user and the idea was to have pairs of dumbbells or sets of barbells in set increments such as 5 lb., 10 lb., 20 lb., 30 lb., etc. permanently fixed normally by the use of a handle or bar where individual weight plates are put on each end of a handle or bar. They are normally secured with either a washer and bolt or an end plate (which is a larger version of a washer used to conceal the bolt) and a bolt. The idea was to provide a safer method to do heavy training without the concern of the dumbbells or barbells coming loose and injuring the user. To improve this method a liquid thread locking compound, or similar nylon patch was put on the bolt to eliminate the bolt from loosening and backing out. This method works fairly well unless the internal threads are not free of oil and other residue upon initial installation. In this case the locking compounds never properly seal. With these methods repeated loosening and tightening diminish the holding power considerably whereas once loosened full strength cannot be achieved without reapplication of compounds. The shock from banging together during use and the dropping on the floor when the user is finished puts stress on the bolt causing it to loosen and back out. In many cases, especially on heavier sizes, this applied shock will cause the bolt to shear and therefore the dumbbells and barbells can come apart potentially causing injury to the user. In these methods individual plates are put on both ends of a handle or bar then the accepted measure for the length of the handle or bar is that the last plate must stick out past the handle or the bar so when tightened with either the washer or the end plate it will be tight. The danger is that there is an unsupported area between the end of the bar or handle and the bolt. Often the installer will consider it a sufficient and safe connection as long as the handle or bar is barely into the last plate which increases the stress during shock. The optimum way would have been to have each and every size weight increment have a handle or bar that was just below the last plate installed, therefore reducing the unsupported area to a minimum. This was never done due to the multiple handle or bar requirements. In addition, conventional castings have inconsistencies in thickness which would create even more handles or bars required. Even going to this extreme would not eliminate the blind unsupported area between the handle and the back of the washer or end plate.

In today's methods there are approximately 10 sizes of dumbbell handles used and 10 sizes of barbell bars used serving as a "catch all method." These methods work but do not provide the highest degree of strength and safety. In some cases upon installation of the current methods the handle or bar may be near flush with the last plate installed prior to tightening and after a high degree of usage internal plate wear causes the handle to protrude past the last plate making tightening impossible. These current methods will only stay tight if the handle or the bar is below the last installed plate on each end. This is why many equipment owners find the problem of a bolt that is tight, but the plates are not. It is also considered optimum to have these plates remain tight and not spin. Lastly, it is very difficult and rare for the normal purchaser of these products to have the special tools required to remove broken bolts or even be able to tighten and loosen them.

Solid steel dumbbells have emerged as a solution to the conventional methods to eliminate this loosening and breaking problem. In this design, a pair of solid one piece slugs are welded to a handle or a bar. In this method, the disadvantage is that it requires precise methods of welding to ensure a strong safe bond. This method is more expensive than with the use of cast iron. With this style of dumbbell, the user will experience a sharp ringing sound when they make contact with each other which is not desirable. Until now, no dumbbell or barbell has been viewed as permanent other than this solid steel welded method.

Solid steel dumbbells have emerged as a solution to the conventional methods to eliminate this loosening and breaking problem. In this design a pair of solid one piece slugs are welded to a handle or bar. In this method, the disadvantage is that it requires precise methods of welding to ensure a strong, safe bond. This method is more expensive than with the use of cast iron. With this style of dumbbell, the user will experience a sharp ringing sound when they make contact with each other which is not desirable. Until now, no dumbbell or barbell has been viewed as permanent other than this solid steel welded method.

In summary as shown in FIGS. 1A–1C and FIGS. 2A–2B, those devices, methods and mechanisms of the prior art were not able to solve these issues. By enumerating not only the cause of the instant problem for each alternative design, but actually conceiving, reducing to practice and prototyping the instant invention the present inventor has both identified and overcome a longstanding problem in the weight-lifting arts.

According to a feature of the invention there is provided a process for securing weights on a barbell, which comprises the steps of: providing at least two locking nuts having fail-safe locking means, a bar or handle, and desired weight plates; disposing the desired weight plates at a fixed spaced relationship to each other; and tightening the at least two locking nuts by isolating the load from the nut body. An apparatus made by the process is likewise taught.

According to a further feature of the invention there is provided a novel enhanced dumbbell system, comprising, in combination: at least one of a handle and a bar; a plurality of weight plates; and a means for lockingly engaging a desired number of weight plates in a fixed spatial relationship about said at least one of a handle or bar.

This design uses a special threaded female body with an oblong spring steel insert that goes on under pressure which forces the insert to conform to the threaded shaft then, once applied pressure ceases it, retains its original oblong shape, which basically pinches the shaft and will not back off. The torque required is far less than previous methods. It may be loosened or tightened as needed. It is considered adjustable because if, for some reason, there was wear and the original surfaces of the plates wore away you could tighten the fastener slightly and it would be snug again. In conventional methods, a bolt is usually used with a thread locking compound or nylon patch on the threads. Both of these methods make loosening impossible without special tools and there is no forward adjustment. The new method virtually locks in place wherever you leave it. It can be used with individual plates or a solid block design of cast iron steel. The finishes could be paint, rubber or urethane coated. By using a 1.062 inch diameter threaded shaft in conjunction with the female locking device, there is no bolt to shaft connection. Individual plates or a solid block goes on each end and then held in place with a rubber end plate that acts like a washer that the female fastener snugs up against to form a tight bond (it is countersunk to hide fastener). In conventional methods, a ½ inch or ⅝ inch diameter bolt is used and various sized handles go through individual plates leaving a blind spot between the end of the handle and the back of the end plate. Under shock loads and constant banging or dropping is where failure occurs snapping bolts. With the new version the connection is far stronger with no blind or unsupported area and the actual shaft which replaces the bolt is much larger and far stronger than any existing bolt to handle method. Dumbbells in health clubs go up to 150 lbs. and over per handle. It would be very dangerous if they were to break over the head or body of the user.

OBJECT AND SUMMARY OF THE INVENTION

New Adjustable Locking Dumbbell/Barbell Design

Unique—This design uses a special threaded female body with an oblong spring steel insert that goes on under pressure which forces the insert to conform to the threaded shaft then once applied pressure ceases it retains its original oblong shape which basically pinches the shaft and will not back off. The torque required is far less than previous methods. It may be loosened or tightened as needed. It is considered adjustable because if for some reason there was wear and the original surfaces of the plates wore away you could tighten the fastener slightly and it would be snug again. In conventional methods, a bolt is usually used with a thread locking compound or nylon patch on the threads. Both of these methods make loosening impossible without special tools and there is no forward adjustment. The new method virtually locks in place wherever you leave it. It can be used with individual plates or a solid block design of cast iron steel. The finishes could be paint, rubber or urethane coated.

Safer—By using a 1.062" diameter threaded shaft in conjunction with the female locking device there is no bolt to shaft connection. Individual plates or a solid block goes on each end then held in place with a rubber end plate that acts like a washer that the female fastener snugs up against to form a tight bond (it is countersunk to hide fastener). In conventional methods, a ½" or ⅝" diameter bolt is used and various size handles go through individual plates leaving a blind spot between the end of the handle and the back of the end plate. Under shock loads and constant banging or dropping is where failure occurs snapping bolts. With the new version the connection is far stronger with no blind or unsupported area and the actual shaft which replaces the bolt is much larger and far stronger than any existing bolt to handle method. Dumbbells in health clubs go up to 150 lbs. and over per handle. It would be very dangerous if they were to break over some ones' head or body.

With the solid block design the weights can be calculated to allow for longer handle weights. In conventional methods, the weight is off in the larger sizes,as the dumbbell gets heavier (longer) so does the handle and with standard plates available, i.e. 2.5 lb., 5 lb., 7.5 lb., 10 lb. There is no way to adjust and as a result a 150 lbs. is as much as 5 lbs. overweight. With the use of a new 11.25 lb. weight also unique to the fitness industry, sizes from 100 lbs. to 150 lbs. can now be more accurate.

No other dumbbell uses this type of fastening device. No other dumbbell is considered adjustable and may be tightened further once assembled. No other dumbbell uses a shaft and a threaded female concept except some import low end sets where you actually change plates to increase or decrease weight, but this is not done in commercial environments. Those systems are not permanent and will loosen and back off. No other dumbbell uses a locking device that will not back off under shock and vibration. No other dumbbell or barbell uses a fastening device that locks wherever you leave it. No other fixed dumbbell or barbell is assembled in a manner where the handle or bar goes completely through the individual plates, solid block and end plate whereas the end plate acts as only a washer instead of a supporting member. No other fixed dumbbell or barbell is used in a solid block design where a female locking insert retains the handle or bar to the block. This new method is stronger by several times over any current fixed method of individual component fastening. No other fixed method can be manipulated with the same degree of ease. This method also accommodates for inconsistencies in plate or block thickness.

The industry and the customer often choose solid steel dumbbells where two solid ends are welded to a handle. This was devised to eliminate loosening and breaking. The negatives are that you cannot use cast iron, only steel. If the welding is not done properly they have been known to snap off at the weld and also when they bang together they ring. Cast iron is more dead sounding and by using the rubber end plate the ringing goes away and the end plate protects the finish. We will also produce this with a paint, rubber or urethane coating.

BRIEF DESCRIPTION OF THE INVENTION

Figure 1B:
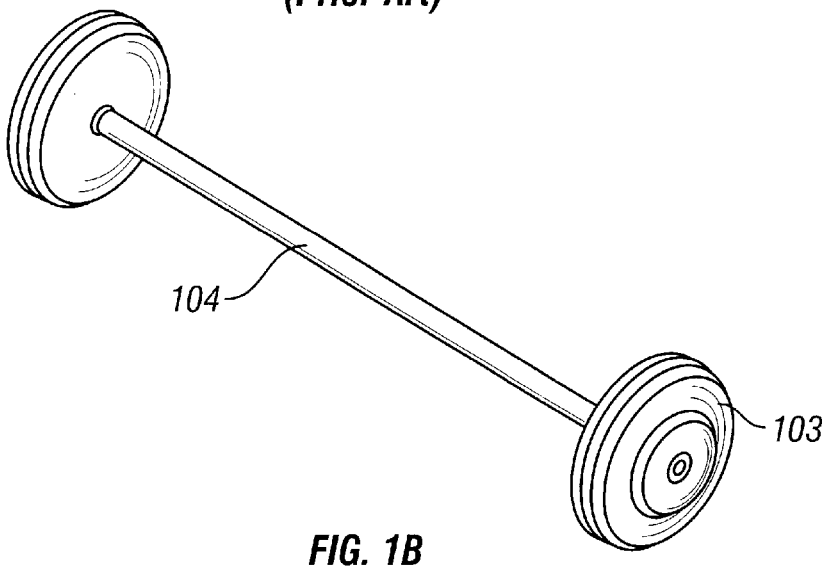
FIG. 1B (Prior Art)
Figure 1C:
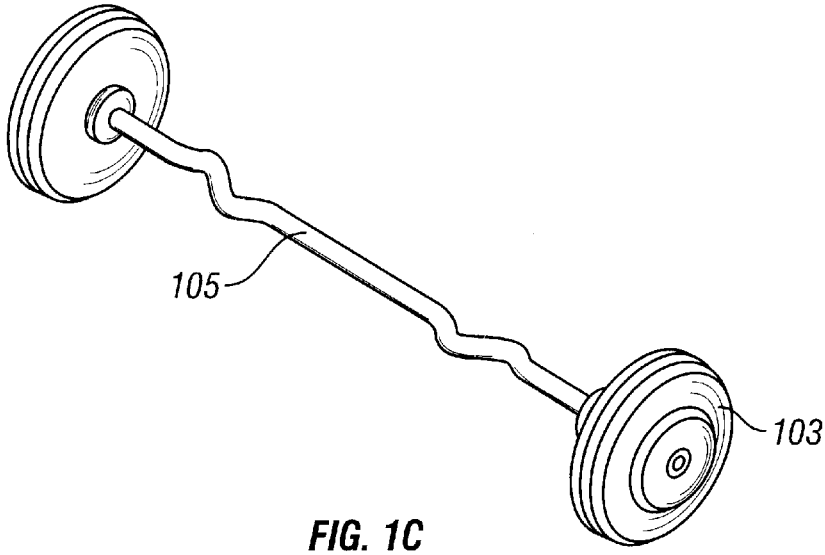
FIG. 1C (Prior Art)
Figure 2A:
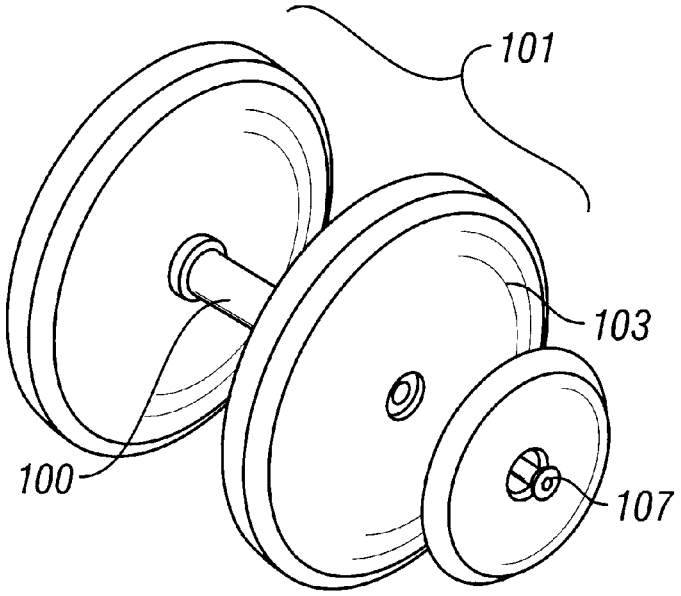
FIG. 2A (Prior Art)
Figure 2B:
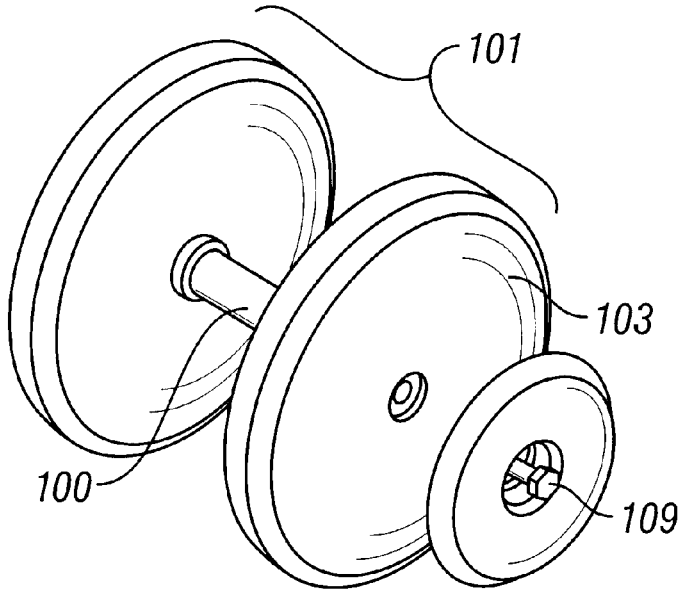
FIG. 2B (Prior Art)
Figure 3A:
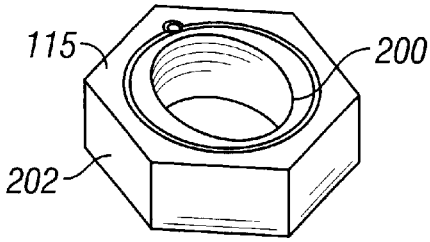
Figure 4A:
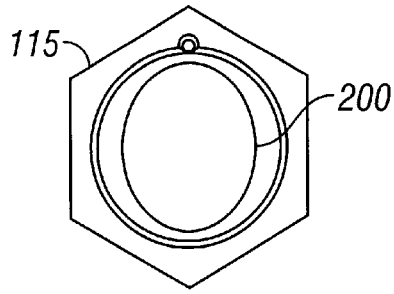
Figure 3B:
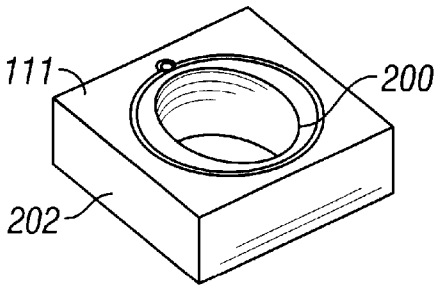
Figure 4B:
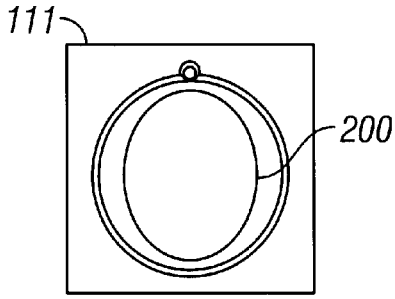
Figure 3C:
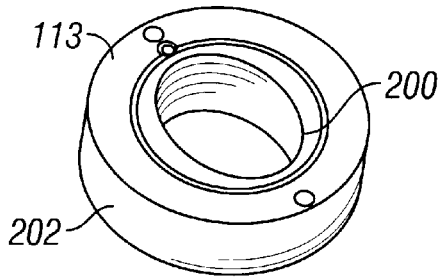
Figure 4C:
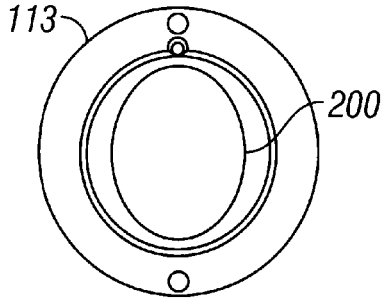
Figure 3D:
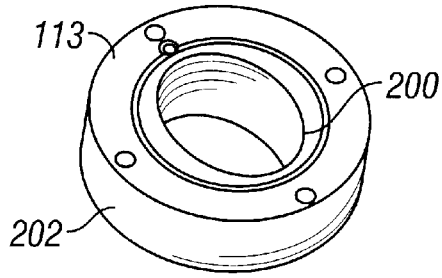
Figure 4D:
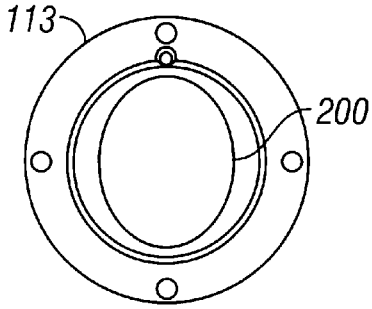
Figure 5A:
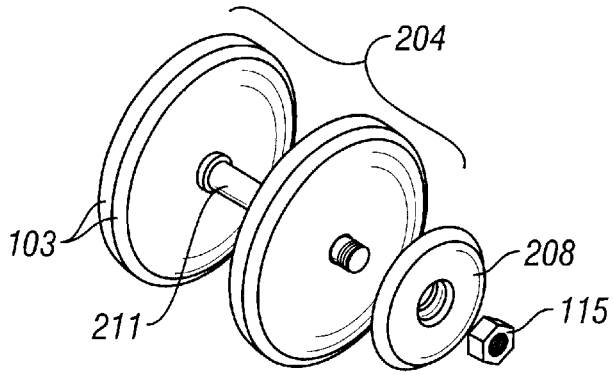
Figure 5B:
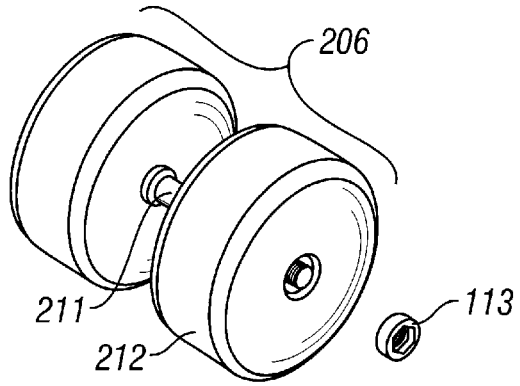
Figure 5C:
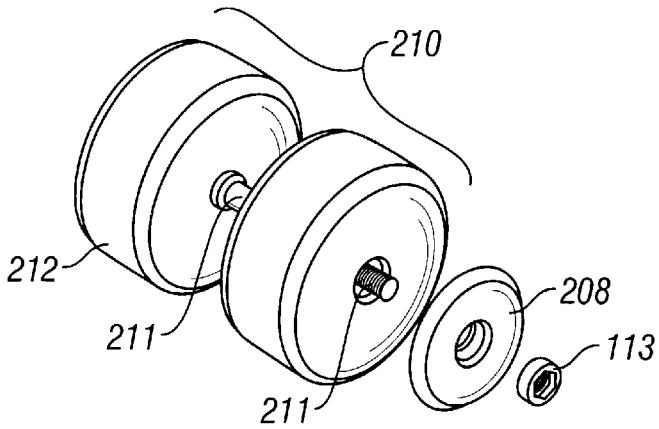
Figure 6A:
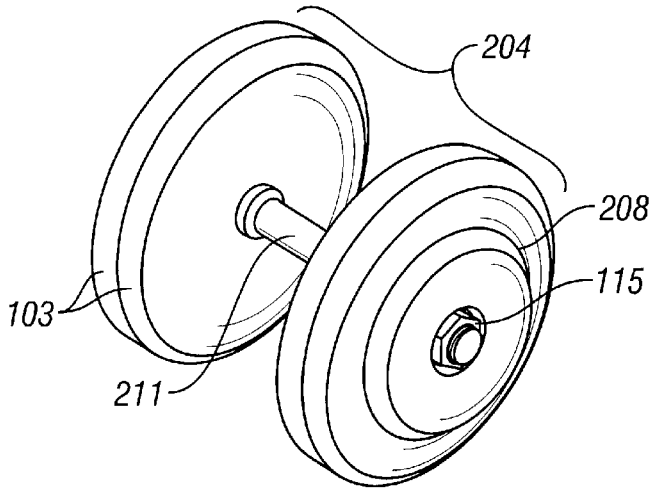
Figure 6B:
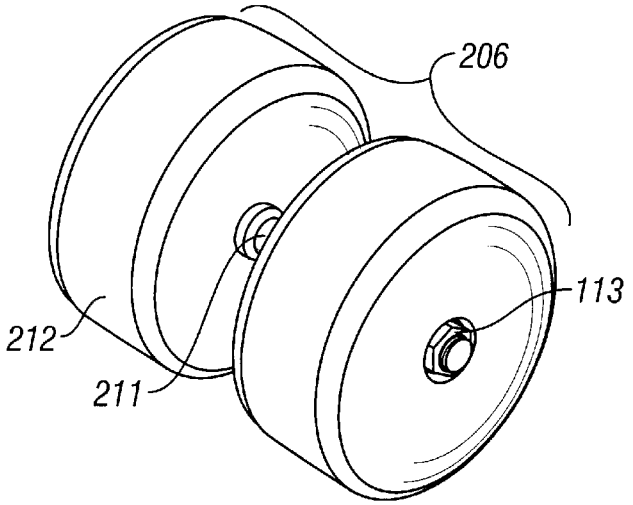
Figure 6C:
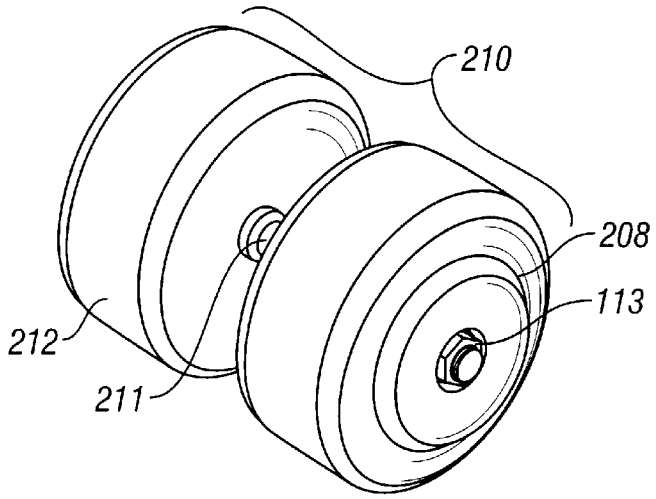

FIGS. 1A–1C are schematic views of three known prior art systems;

FIGS. 2A–2B likewise illustrate more detailed views of two of these attempts to solve the issues addressed by and overcome according to the teachings of the present invention, as shown in FIG. 1;

FIGS. 3A–3D show four schematized iterations of locking bodies according to the instant teachings from plan views, according to embodiments of the present invention;

FIGS. 4A-4D provide top views of locking bodies, according to embodiments of the present invention;

FIGS. 5A–5C show schematized, partially exploded views, according to embodiments of the present invention; and, FIGS. 6A–6C show fully assembled weight lifting equipment, according to embodiments of the present invention.

DETAILED DESCRIPTION OF THE INVENTION

The present inventor has been involved on a professional level in the health and fitness industry and has recognized, designed around, and ameliorated the longstanding problems associated with fixing weights on bars hoisted by users for exercise and competition. Referring now to FIG. 1A, there is shown a conventional dumbbell handle 100 with associated weight assembly 101 having, for example, a flat head bolt as its means for securing weight plates. As noted above, issues including slipping, and the like changes in position of the weight plates 103, relative to handle 100 are known to make this design in need of improvement.

Likewise FIG. 1B, straight bar 104 can be used with either a flat head screw, hex head bolt, or liquid thread compound to attempt to secure weight plates 103 to straight bar 104. Similarly in FIG. 1C, curled bar 105 is subject to the same issues in attempting to maintain the weights 103 in a fixed position.

Referring now to FIGS. 2A–2B, partially exploded views are shown of weight assembly 101, with weight plates 103 respectively held in place by way of flat head bolt 107 and hex head bolt 109. As discussed above, the mechanical stresses placed upon such securing means 107, 109 often result in undesired rotation of plates 103 about bar 100, or even dislodging of the same. Such issues render highly difficult the changing of plates 103 for different sets, and /or usage of the same without safety concerns and constant monitoring of such known systems.

FIGS. 3A–3D show systems according to the present invention, including vibration proof locking bodies 111, 113, 115 (available from SECURITY LOCKNUT INC., Chicago, Illinois 60656) which solve the instant problems when used according to the instant method with at least one conventional bar assembly 100, 104, 105.

Referring now to FIGS. 4A–4D, each of vibration proof locking bodies 111, 113, 115 are shown from top and plan views whereby locking means 200 can be seen as distinct from the principal body of each nut 202. Those having a modicum of skill in the art will readily understand that the instant teachings uniquely allow for a barbell user to further tighten the assembly once the same has been put together. Namely, locking means 200 raises away from principal body of nut 202 when force is applied. Thus, mechanical isolation of the load is achieved.

Referring now to FIGS. 5A–5C, new style barbells are shown generally at 204 206, and 210. In an exploded view, locking body 115 (with locking means 200 and principal body of nut 202 included but not further shown for want of size) secures supplemental plate 208 (as shown in FIGS. 6A and 6C) such that no backing off occurs irrespective of the vibration. It is noted that handle or bar 211 extends throughout the length of each of the new style barbells shown at 204, 06, and 210.

Likewise, FIGS. 6A–6C show individual plates with end plate and locking nut 204 in an assembled state, along with single block with end plate and locking nut 210, in addition to single block with locking nut and no end plate 206.

What is claimed is:

1. A method for securing weights to weight-lifting apparatus comprising the steps of:

(a) providing an elongated shaft having threaded ends and a circular cross-section, a plurality of weights, and a single locking nut on each threaded end, said locking nut comprising a nut body and a spring steel oblong threaded insert located within said nut body;

(b) disposing a desired number of said weights in a fixed spatial relationship on said shaft;

(c) placing a single locking nut on each of the threaded ends of said shaft;

(d) applying light hand tool pressure on each of said nut bodies to form a non-locking engagement of said locking nut with each of the threaded ends; and (e) applying sufficient torque to each of said nut bodies to form a fail-safe locking and vibration proof engagement of said locking nut with each of the threaded ends and to conform each of the threaded inserts to the circular shape of said shaft by rising away from said nut body and isolating the load from said nut body to said threaded insert such that each of the locking nuts does not back off the threaded end of said shaft under shock and vibration.

2. A weight-lifting apparatus resulting from the method of claim 1.

3. The apparatus defined in claim 2 wherein each of said locking nuts may be further tightened by application of additional torque upon said nut body.

4. The apparatus defined in claim 2 wherein said weight-lifting apparatus maintains its configuration, irrespective of mechanical stress and strain.

5. The apparatus defined in claim 2 wherein said shaft is a handle of a dumbbell.

6. The apparatus defined in claim 2 wherein said shaft is a bar of a barbell.

7. The apparatus defined in claim 2 wherein said weights are weight plates or blocks of cast iron or steel.

8. Weight-lifting apparatus comprising:

(a) an elongated shaft having threaded ends, said shaft being a handle of a dumbbell or a bar of a barbell;

(b) a plurality of weights mounted on said shaft;

(c) locking means for lockingly engaging a desired number of said weights in a fixed spatial relationship on said shaft, said means comprising a single locking nut threadably engaged on each of the threaded ends of said shaft, each of said locking nuts comprising;

(i) a nut body, and (ii) a spring steel oblong threaded insert located within said nut body to form a non-locking engagement with one of said threaded ends upon light pressure on said outer nut body, and to form a fail-safe locking and vibration proof engagement with the threaded end upon the application of sufficient torque to cause said oblong insert to conform to the circular shape of said shaft by rising away from said nut body and to isolate the load from said nut body to said threaded insert such that each of the locking nuts does not back off the threaded end of said shaft under shock and vibration.

9. The apparatus of claim 8 wherein said weights are weight plates.

10. The apparatus of claim 9 wherein a supplemental end plate is mounted between a weight plate and said locking nut at each end of said shaft.

11. The apparatus of claim 8 wherein said weights are blocks of cast iron or steel.

12. The apparatus of claim 8 wherein each of said locking nuts may be further tightened upon application of additional torque on said nut body.

* * * * *